United States Patent [19]

Matsuda et al.

[11] Patent Number: 4,520,932

[45] Date of Patent: Jun. 4, 1985

[54] STAMP DETECTION IN A MAIL PROCESSING APPARATUS

[75] Inventors: Yoshihiro Matsuda; Hiroshi Kimishima; Yoshikazu Kado, all of Tokyo, Japan

[73] Assignee: Nippon Electric Co., Ltd., Tokyo, Japan

[21] Appl. No.: 462,224

[22] Filed: Jan. 31, 1983

[30] Foreign Application Priority Data

Jan. 29, 1982 [JP] Japan ..... 57-13462

[51] Int. Cl.[3] ..... B07C 5/342

[52] U.S. Cl. ..... 209/545; 209/578; 209/900

[58] Field of Search ..... 209/540, 541, 545, 576, 209/577, 578, 900; 198/394, 395; 250/271, 302, 365, 372, 461.1; 101/2

[56] References Cited

U.S. PATENT DOCUMENTS

| | | | |
|---|---|---|---|
| 2,894,626 | 7/1959 | Mulders et al. | 209/578 |
| 2,947,406 | 8/1960 | Hazelton, Jr. | 209/900 X |
| 2,988,984 | 6/1961 | Eckert, Jr. et al. | 209/900 X |
| 3,027,830 | 4/1962 | Yaeger | 209/3.2 X |
| 3,207,910 | 9/1965 | Hirschfeld et al. | 209/577 X |
| 3,938,435 | 2/1976 | Suda et al. | 209/900 X |

*Primary Examiner*—Robert B. Reeves
*Assistant Examiner*—Edward M. Wacyra
*Attorney, Agent, or Firm*—Laff, Whitesel, Conte & Saret

[57] ABSTRACT

A mail processing apparatus feeds mail articles one by one, along a transport path. A stamp detecting device is disposed along the path to detect a stamp on the mail article. The stamp detecting device includes a light source for radiating ultraviolet light towards both sides of the mail article in the transport path, and converters for converting the luminescences excited by the ultraviolet light on both sides of the mail article. Two signal levels are detected and compared for determining where the stamp is located. This way, a stamp does not appear to be on both sides of a very thin article.

15 Claims, 8 Drawing Figures

STAMP DETECTION IN A MAIL PROCESSING APPARATUS

BACKGROUND OF THE INVENTION

This invention relates to an apparatus for processing mail articles such as postcards and letters, and more particularly to a stamp detector used in a mail processing apparatus such as a mail cancelling and/or facing apparatus.

Luminescent stamps that emit fluorescence or phosphorescence have been widely used as postage stamps in, for example, Europe and U.S.A. In mail cancelling and/or facing apparatus, therefore, the fluorescence or phosphorescence emitted from the postage stamps is utilized to detect the postage stamps. In the conventional mail cancelling and facing apparatus, as disclosed in the U.S. Pat. No. 3,938,435 entitled AUTOMATIC MAIL PROCESSING APPARATUS issued to Suda et al., the mail articles are taken one by one from a mail feeding portion and are transferred through a transport path. The stamp on the mail article is then detected by stamp detectors disposed along, and on both sides of, the transport path. Then, the stamp is cancelled by cancellers which are disposed on both sides of the transport path and are selectively actuated on the basis of the results of the stamp detection. The mail articles are positioned to face with the stamps in the same relative position, in response to the positions of the detected postage stamps.

In order to improve the mail processing efficiency in the mail cancelling and facing apparatuses of this kind, the sensitivity of the stamp detector has been increased to detect the stamps which emit a weak luminescence. However, when the stamp having large intensity of emitting fluorescence or phosphorescence is put on a thin mail article, such as a thin postcard, the emitted luminescence would penetrate to the reverse side of that article. Hence, both of the pair of stamp detectors disposed on opposite sides of the transport path would produce stamp detection outputs. In this case, the mail article is not processed and is rejected as an abnormal mail article. For this reason, the processing efficiency, or detection ratio, of the conventional mail cancelling and facing apparatus would drop if a large number of thin mail articles are contained in a batch of mail articles. If the sensitivity of the stamp detector is reduced to prevent such an erroneous operation, the stamp having a low luminescent intensity can not be detected and consequently, the subsequent cancelling and/or facing operation can not be effected. This also results in the deterioration of the processing efficiency of the apparatus.

SUMMARY OF THE INVENTION

It is therefore an object of the present invention to provide a mail processing apparatus which can reliably detect a luminescent stamp on a mail article, even if the mail article is so thin that the luminescence emitted from the stamp penetrates from its upper surface to its reverse surface.

It is another object of the present invention to provide a mail processing apparatus which can reliably detect a stamp on a mail article, even if the stamp has low luminescent intensity.

In accordance with the present invention, a mail processing apparatus comprises a feeding device for feeding mail articles one by one to a transport path. A stamp detecting device is disposed along the transport path for detecting a stamp on the mail article. The stamp detecting device includes a light source for radiating ultraviolet light on to both sides of the mail article as it moves in the transport path. Converters on both sides of the mail article respond to the luminescences excited by the ultraviolet light to produce two signal levels. A comparator compares the two signal levels and selectively gates them in response to the output of the comparator. A stamp determining circuit compares the gated signal level with a predetermined thereshold level.

In accordance with a first embodiment of the present invention, a mail cancelling and facing apparatus comprises a feeding device for feeding mail articles one by one, in a standing state. A first transport path transfers the mail articles from the feeding device. A first stamp detecting device is disposed along the first transport path for detecting a stamp at the lower part of the mail article and on both sides of the mail article. A second transport path advances the mail article in a straight line if the stamp is detected by the first stamp detecting device and over a twisting path if the stamp is not detected. A third transport path transfers the mail article transported from the second transport path. A second stamp detecting device is disposed along the third transport path for detecting the stamp at the lower part of the mail article and at both sides of the mail article.

A pair of cancellers are disposed downstream of the second stamp detecting device, one canceller on each side of the third transport path for cancelling the stamp. A fourth transport path is disposed in succession to the third transport path downstream of the pair of cancellers for reversing the direction of the mail article whose stamp is cancelled by one of the cancellers and for transferring the mail article whose stamp is cancelled by the other canceller.

A stacker is disposed downstream of the fourth transport path for stacking the mail articles. Each of the first and second stamp detecting devices include two luminescence receiving elements for receiving the luminescence derived from the same position on both surfaces of the mail article. A comparing circuit compares the output level delivered from the two luminescence receiving elements and a selecting circuit selects one of the outputs from the two luminescence receiving elements, in accordance with the output of the comparing circuit.

BRIEF DESCRIPTION OF THE DRAWINGS

FIG. 2 illustrates the construction of the stamp detecting device according to the present invention;

DESCRIPTION OF THE PREFERRED EMBODIMENTS

Figure 1:
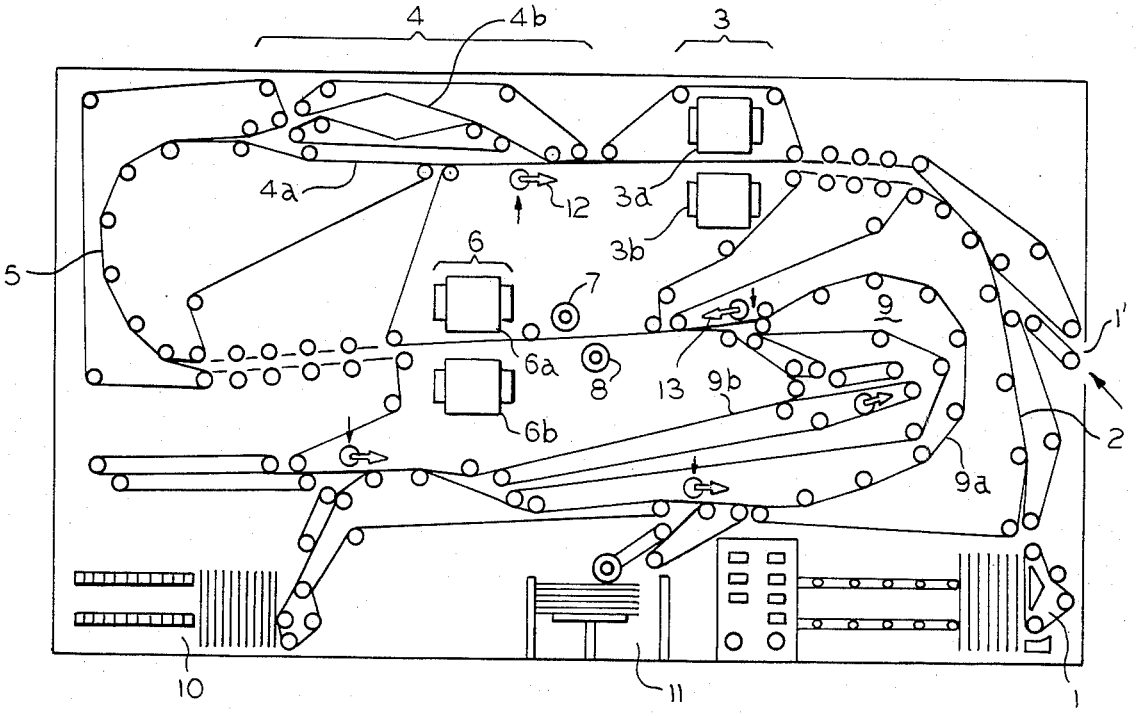
FIG. 1 illustrates an embodiment of the present invention, especially its mechanical portions, taken as a whole.

In a first embodiment of the present invention shown in FIG. 1, mail articles are fed, one by one, from a feedding device 1 and are transferred through a first transport path 2 while being kept in a standing state. A stamp on the mail article is detected at both sides of the transport path by a first stamp detecting device 3 that is disposed along the transport path 2. In this embodiment, the numeral 1' indicates a sub-transport path which receives a mail article supplied from another mail handling apparatus. The first stamp detecting device 3 comprises two stamp detectors 3*a* and 3*b* disposed on both sides of the transport path and positioned to scan the lower part of the mail articles.

Figures 2A, 2B, 2C, 2D:
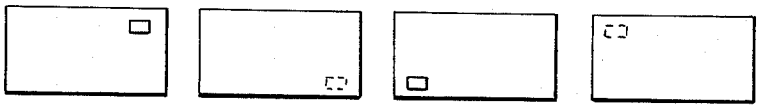
FIGS. 2(*a*), 2(*b*), 2(*c*) and 2(*d*) indicate the four possible positions of a stamp on a mail article which is supplied to the embodiment shown in FIG. 1.

The mail articles fed from the feeding device 1 can be classified into four groups, as shown in FIGS. 2(*a*) through 2(*d*), depending upon the position of the stamp. The first stamp detecting device 3 can detect the stamp positions shown in FIGS. 2(*b*) and 2(*c*). Among the mail particles that leave the first stamp detecting device 3, the mail article whose stamp is detected by the detecting device 3 passes through a straight path 4*a*. The mail article whose stamp is not detected passes through a twisting path 4*b*, including twist belts which turn it upside down, and then it is sent to a third path 5. Thus, all of the mail articles that pass through the third transport path 5 are sent under the positions shown in FIGS. 2(*b*) and 2(*c*), except for those which have no stamp.

A second stamp detecting device 6 is disposed along the third transport path 5 and it also scans the lower parts of the mail articles. The second stamp detecting device 6 also comprises a pair of stamp detectors 6*a* and 6*b* which are disposed at opposite sides of the transport path 5. The stamp detector 6*a* detects the stamp on the mail article whose stamp is put on the left side with respect to the travelling direction, and this stamp is cancelled by a canceller 7. On the other hand, the stamp detector 6*b* detects the stamp on the mail article whose stamp is put on the right side, with respect to the travelling direction, and a canceller 8 imprints the cancelling mark (postmark) upon it.

A fourth transport path 9 is formed downstream of these cancellers 7 and 8 and consists of a straight path 9*a* and a direction reversing path (switch-back path) 9*b*. The mail article whose stamp is cancelled by the canceller 8 passes through the straight path 9*a* and is stacked in a stacker 10. On the other hand, the mail article whose stamp is cancelled by the canceller 7 passes through the switchback path 9*b* and is stacked in the stacker 10. The mail article whose stamp is not detected is transferred to the straight path 9*a* and then stacked in a rejection stacker 11.

Diverters 12 and 13 are disposed at the inlets of the second and fourth transport paths 4 and 9, to selectively feed the mail article into the transport path 4*a* and 4*b*, and 9*a* and 9*b*, respectively, in accordance with the detection results of the stamp detecting devices 3 and 6. Accordingly, all the mail articles packed in the stacker 10 are facing in the same stamp position.

Figure 3:
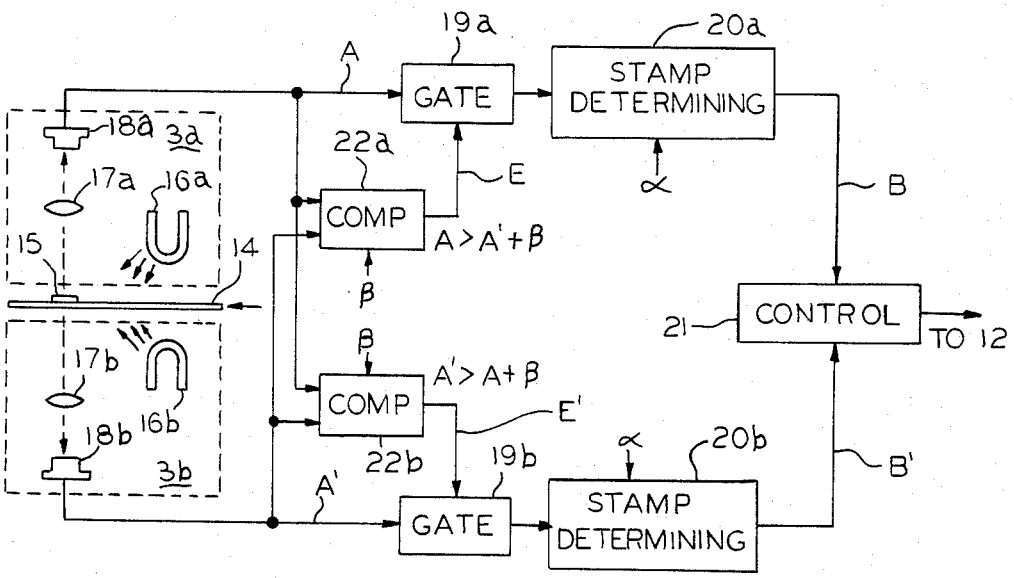

Next, the stamp detecting devices 3 and 6 shown in FIG. 1 will be explained, referring to FIG. 3. Since they have the same construction, only the stamp detecting device 3 will be described. In FIG. 3, the fluorescence- or phosphorescence-emitting stamp 15 is on the transported mail article 14. The stamp detecting device 3 includes the pair of stamp detectors 3*a* and 3*b*. The stamp detectors 3*a* and 3*b* includes ultraviolet light sources 16*a* and 16*b*, scanning optical elements 17*a* and 17*b*, and photoelectric conversion elements 18*a* and 18*b*, respectively. The ultraviolet lights from the ultraviolet light sources 16*a* and 16*b* excite both the luminescent emitting stamp 15 and the opposite side of the mail article.

The secondary luminescence, such as fluorescence and phosphorescence, is derived from the stamp 15. This luminescence is detected by the photoelectric conversion elements 18*a* and 18*b*. The detection levels A and A' (FIG. 4) are delivered from the respective elements 18*a* and 18*b* and are applied to stamp determining circuits 20*a* and 20*b* via gates 19*a* and 19*b*, respectively. The stamp detectors 3*a* and 3*b*, in this case, are located to detect the same position on opposite sides of the mail article. When the detected level of the signal supplied to the determining circuit 20*a* or 20*b* is greater than a predetermined threshold level, the circuit determines that the stamp is detected. A control circuit 21 receives the outputs of both determining circuits 20*a* and 20*b* and controls the diverter 12 (FIG. 1) in accordance with the result.

In the prior art apparatus, the stamp detection outputs are sometimes derived simultaneously from both the determining circuits 20*a* and 20*b* so that the mail article is transferred to the rejecting stacker. In contrast, the present invention eliminates such a problem by the use of comparators 22*a* and 22*b* which compare the detection levels A and A' with each other. Only if the detection level A from the photoelectric conversion element 18*a* is greater than a predetermined amount above a predetermined threshold value $\beta$, as compared to the detection level A' from the element 18*b* ($A > A' + \beta$), the comparator 22*a* does not produce an inhibit signal for the gate 19*a*. In this case, the other comparator 22*b* produces an inhibit signal for the other gate 19*b*. When $A' > A + \beta$, on the other hand, the comparator 22*b* does not produce the inhibit signal for the gate 19*b* while the comparator 22*a* produces the inhibit signal for the other gate 19*a*. According to this arrangement, the two stamp determining circuits do not simultaneously produce two stamp detection outputs, which cause the mail article rejection. Thus, there is no article rejection even when a stamp having a high luminescent intensity is put on a very thin mail article.

According to the present invention, only the detection level corresponding to a more sufficient luminescent intensity is applied for detecting the stamp. Furthermore, according to the present invention, it is possible to shift to a lower threshold level $\alpha$, in order to detect a stamp having a lower luminescent intensity. In this embodiment the scanning optical elements 17*a* and 17*b* scan the same position on both sides of mail article. Therefore, a signal timing adjustment is easily performed in the blocks 22*a*, 22*b*, etc.

Figure 4:
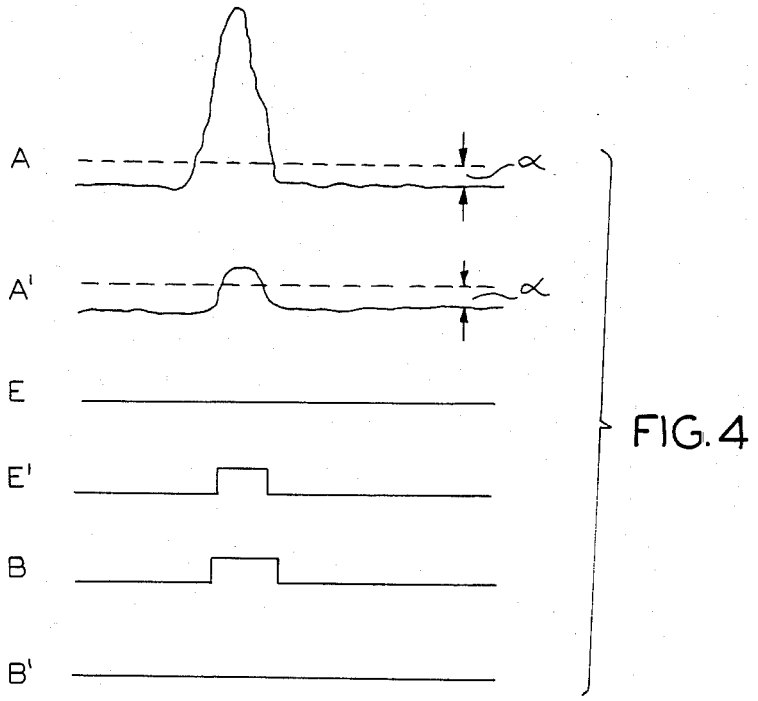
FIG. 4 shows waveforms which are useful for explaining the operation of the stamp detecting device shown in FIG. 3.

In FIG. 4, the detection levels A and A' are derived from the photoelectric conversion elements 18*a* and 18*b* both exceed the threshold value $\alpha$. Hence, both stamp determining circuits 20*a* and 20*b* detect a stamp without comparators 22*a* and 22*b*. In the present invention, since the comparator 22*b* produces the inhibit signal E', only the output B of the stamp determining circuit 20*a* is applied to the control circuit 21.

Figure 5:
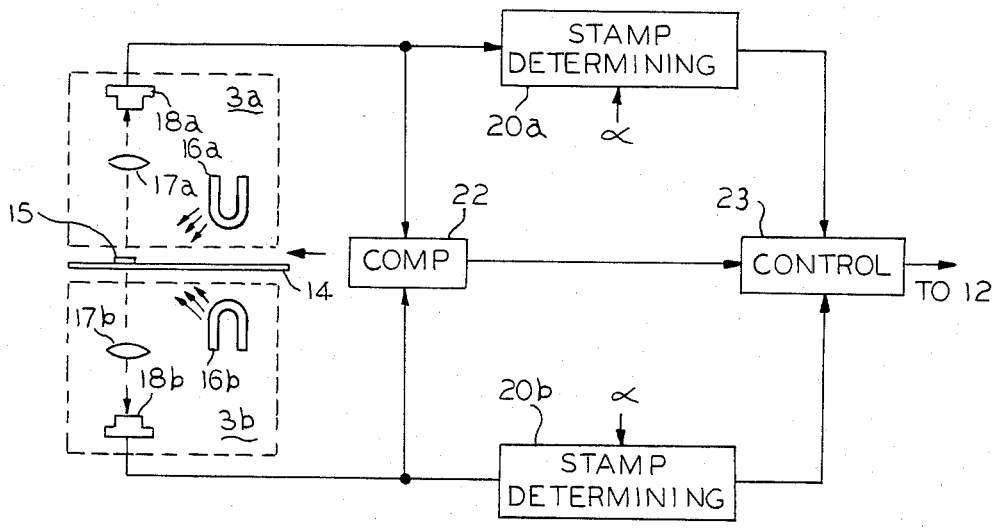
FIG. 5 illustrates the second embodiment of the present invention, especially its stamp detecting device.

The embodiment shown in FIG. 3 makes use of the two comparators 22*a* and 22*b*. However, the gates 19*a* and 19*b* can be easily and selectively controlled by use of one comparator. FIG. 5 shows such an embodiment.

The outputs of the photoelectric conversion elements 18*a* and 18*b* are directly applied to the stamp determining circuits 20*a* and 20*b*. The outputs of these circuits 20*a* and 20*b* are applied to the control circuit 23. The comparator 22 compares the detection levels of the elements 18*a* and 18*b* with each other. The control circuit 23 selects one of two outputs delivered from the circuits 20*a* and 20*b*, and produces either a diverting signal for the diverter 12 or a cancelling signal for the canceller when the circuit 23 selects a predetermined one of the two outputs and the selected one is effective, i.e. when the level from the photoelectric conversion element supplied to the selected stamp determining circuit 20*a*, 20*b* is greater than the threshold level.

As mentioned above, when the apparatus embodying the present invention is operated for cancelling and facing the mail article having the luminescent stamp on it, it can detect exactly the stamp even if there are variations in emitting luminescence.

What is claimed is:

1. A mail processing apparatus comprising means for feeding mail articles one by one into a transport path, and means disposed along said transport path for detecting a stamp on each of said mail articles, said apparatus being characterized in that said stamp detecting means includes:

a light source for radiating light to opposite sides of said mail articles in said transport path;

means for converting the luminescences derived from both sides of said mail articles excited by said light into two signal levels, respectively;

means for comparing said two signal levels from opposite sides of each of said mail articles;

means for selectively gating one of said two signal levels in response to the output of said comparing means; and a pair of means for determining stamp detection by comparing said gated signal level derived from said gate means with a predetermined threshold level.

2. The mail processing apparatus as claimed in claim 1, in which said converting means receives luminescence derived from the same position on opposite sides of said mail articles.

3. A mail processing apparatus comprising means for feeding mail articles one by one into a transport path, and means disposed along said transport path for detecting a stamp on each of said mail articles, characterized in that said stamp detecting means includes:

light source means for radiating light onto opposite sides of said mail articles as they are transported in said transport path;

means for converting the luminescence derived from both sides of said mail articles excited by said light into two signal levels, respectively;

means for comparing said two signal levels and deriving an output indicating which one is greater; and means responsive to said two signal levels and to the compared output for producing a stamp detection signal.

4. A stamp detecting and orienting system comprising transport means for conveying mail articles from a source to at least one collection area, means for feeding mail articles from said source into said transport means with random orientation whereby said mail articles may have any one of four initial orientations while in said transport means, means for detecting luminescence on opposite sides of each mail article for locating a stamp on each mail article regardless of which one of the orientations said mail article may then have in said transport means, means responsive to said detecting means for comparing the levels of said luminescence from opposite sides of said mail article, and control means responsive to said comparing means finding a signal having a higher level from a location on one side of said mail article for operating said system to uniquely process the mail article according to the orientation of said mail article which is indicated by said higher level signal.

5. The system of claim 4 and means for radiating light onto opposite sides of each mail article for producing the luminescence detected by said detecting means.

6. The system of claim 5 and means responsive to said comparing means for reorienting said mail articles in said transport means to bring said articles into predetermined positions.

7. The system of claim 5 and means responsive to said comparing means for selectively applying a cancelling marking on one side of said mail article.

8. The system of claim 4 wherein said transport means has a pair of stamp detectors located on opposite sides of said mail article, each of said stamp detectors comprising an ultraviolet light source, an optical element, and a photoelectric conversion means positioned to receive luminescence activated by said light source and directed by said optical element.

9. The system of claim 8 wherein said comparing means comprises at least one comparator coupled to be jointly driven by the outputs of the photoelectric conversion means in each of said pair of stamp detectors, means individually coupled to pass the output of each of said photoelectric conversion means, and control means responsive to the output of said at least one comparator for selecting and passing the output of only one of said stamp detectors.

10. The system of claim 9 wherein there are two of said comparators coupled to be jointly driven by the photoelectric conversion means, and said individually coupled means are a pair of inhibit gates having an inhibit input coupled to an individually associated one of said comparators.

11. The system of claim 9 wherein there is one comparator coupled to be jointly driven by the photoelectric conversion means, said individually coupled means comprises a level detector which produces signals of different levels responsive to signals of said stamp detectors, and said control means selects the output of said individually coupled means having the highest level under the control of said comparator.

12. A process for detecting stamps on one side of mail articles which are thin enough to give stamp readings on their opposite sides, said process comprising the steps of:

(a) radiating light onto opposite sides of said articles;

(b) picking up luminescences caused by reflections on each of said opposite sides responsive to said light falling upon said stamp;

(c) converting the picked up luminescences into electrical signals having levels of signal strength corresponding to the levels of picked up luminescence;

(d) comparing the levels of said electrical signals; and (e) selectively controlling said mail article responsive to the comparison of step (d).

13. The process of claim 12 and the added step of reorienting said mail articles to bring said stamp to a predetermined orientation responsive to said control of step (e).

14. The process of claim 12 and the added step of cancelling said stamp responsive to said control of step (e).

15. The process of claim 12 wherein said step (e) comprises the added step of segregating mail articles which do not have the signal level required for the comparison of step (d).

* * * * *